US008586896B2

(12) United States Patent
Reichle

(10) Patent No.: US 8,586,896 B2
(45) Date of Patent: Nov. 19, 2013

(54) NON-CONTACT RAIL HEATER

(75) Inventor: David L. Reichle, Bradenton, FL (US)

(73) Assignee: David L. Reichle, Bradenton, FL (US)

( * ) Notice: Subject to any disclaimer, the term of this patent is extended or adjusted under 35 U.S.C. 154(b) by 932 days.

(21) Appl. No.: 12/633,488

(22) Filed: Dec. 8, 2009

(65) Prior Publication Data

US 2010/0163543 A1 Jul. 1, 2010

Related U.S. Application Data

(60) Provisional application No. 61/121,466, filed on Dec. 10, 2008.

(51) Int. Cl.
*H05B 1/00* (2006.01)

(52) U.S. Cl.
USPC ..... 219/213; 219/520

(58) Field of Classification Search
USPC ..... 257/213, 520
See application file for complete search history.

(56) References Cited

U.S. PATENT DOCUMENTS

| | | | | |
|---|---|---|---|---|
| 2,910,567 | A | | 10/1959 | Holstein |
| 3,233,097 | A | | 2/1966 | Watkins |
| 3,243,573 | A | | 3/1966 | Weisse et al. |
| 3,264,472 | A | | 8/1966 | Simmons |
| 3,349,722 | A | | 10/1967 | Davis |
| 3,394,251 | A | | 7/1968 | King et al. |
| 3,439,161 | A | | 4/1969 | McElwee et al. |
| 3,697,746 | A | | 10/1972 | Patterson et al. |
| 4,195,805 | A | | 4/1980 | Keep, Jr. |
| RE31,081 | E | | 11/1982 | Keep, Jr. |
| 4,391,425 | A | | 7/1983 | Keep, Jr. |
| 4,429,845 | A | * | 2/1984 | Stover et al. ..... 246/428 |
| 4,671,475 | A | | 6/1987 | Widmer |
| 4,854,244 | A | * | 8/1989 | Rhodes et al. ..... 104/279 |
| 5,004,190 | A | | 4/1991 | Montierth et al. |
| 6,147,308 | A | * | 11/2000 | Santagata ..... 174/75 R |
| 2003/0146207 | A1 | * | 8/2003 | Reichle ..... 219/635 |

* cited by examiner

*Primary Examiner* — Marc Armand
(74) *Attorney, Agent, or Firm* — Marsh Fischmann & Breyfogle LLP; Russell T. Manning

(57) ABSTRACT

An assembly that is adapted to position a track heater in spaced relation proximate to a surface of a track rail of a railroad. The assembly includes at least one heating element, and a hood or housing that is operable to at least partially surround the heating element while positioning the heating element near to track rail. The hood positions the heating element relative to the rail section such that a gap exists between the heating element and the rail section. As the heating element does not contact the rail, the heating element cannot form an electrical by-pass for signals passing through the rail section.

10 Claims, 11 Drawing Sheets

NON-CONTACT RAIL HEATER

CROSS-REFERENCE TO RELATED APPLICATION

This application claims priority and the benefit of the filing date under 35 U.S.C. 119 to U.S. Provisional Application No. 61/121,466, entitled, "NON-CONTACT RAIL HEATER," filed on Dec. 10, 2008, the contents of which are incorporated herein as if set forth in full.

FIELD

The presented inventions relate to railroad track heaters and, in particular, to an improved non-contact track heaters which can be mounted proximate to a surface of a track rail to provide radiative and/or convective heating.

BACKGROUND

Railtrack heaters are often utilized on areas of track rails where it is desirable that the track be devoid of snow, ice and/or moisture. One such area is around sensors (e.g., infrared sensors) that are mounted relative to track rails to detect hot boxes on passing trains. A hot box occurs when the bearings between an axle and wheel (i.e., the box) of a particular train car heat to an excessive temperature that may allow the bearings to fail. Hot boxes present a fire hazard and can lead to the fracturing of the axle and possibly train derailment. Where an infrared sensor monitors a hot box on a passing train, a train engineer may receive a signal originating from the sensor indicating the need to take corrective action. However, if such a sensor is covered with snow or ice or, for example, develops a fogged lens, the sensor may not function for its intended purpose.

Another area where it is desirable to reduce or eliminate snow build up is around railroad track switches. In order to ensure proper functioning of a railroad track switch, it is important that the switching rail (e.g., tapered movable rail, point blade) and stationary rail make good contact when in an engaged position. Accordingly, in cold climates, it is common to heat the rail switch or otherwise guard against buildup of ice or snow at the switch, especially at the interface between the gauge side of the stationary rail and field side of the switching rail. Furthermore, it is also common to heat railroad frogs (e.g., movable point frogs, stationary frogs) as the buildup of ice and/or snow could otherwise inhibit a train wheel from properly crossing over a rail at a rail junction. Malfunctioning of the switch due to such build up presents a danger of derailment potentially resulting in personal injury and/or property damage.

Typically, railroad track heaters provide conductive heat to the rails by being directly mounted and in contact with the rails. One such heater is described in U.S. Pat. No. 5,824,997, the content of which is incorporated herein by reference. Generally, such heaters include a metal jacket that is mounted directly to a rail to maximize thermal conductivity between the heater and the rail.

SUMMARY

Railtrack rails are often subjected to stresses and dynamic overloads that can cause internal faults in the rail, such as oval flaws, horizontal, transverse or longitudinal cracks, star-shaped cracks, breaks in track joints, etc. Because of the inherent danger in a train utilizing a track with such faults, it is important to be able to detect such faults on the track using a non-destructive method. Ideally, rails in a track section with faults can be replaced before the faults become critical.

One method of detecting rail faults involves the use of low voltage signals that are transmitted through the rails at various intervals, each interval essentially functioning as a circuit. For example, at each interval, a low voltage source is connected in series with a current sensor and a resistor to both of the rails. The current sensor will initially record current readings in a situation known to have no breaks or faults in the rail to determine a baseline current reading. Thereafter, if the current sensor measures a significant and sustained deviation in current in an interval, the rails of that specific interval can be inspected for faults or other interruptions. Generally, a break or interruption in the rail leads to increased resistance or an open circuit resulting in a decreased or open current reading for that interval.

One concern that has been recognized is that if a fault or interruption occurs on a portion of the rail coincident with a railroad track heater that is in direct contact with the rail, a current drop in this portion may be reduced. That is, as such heaters typically include electrically conductive metal jackets, there is some concern that such heaters may carry electrical signals that are intended to pass through the rails. Stated otherwise, there is some concern that signals intended to pass through the rail may potentially by-pass a break or fault in the rail and pass through the electrically conductive heater. As a result, the sensor might not record any significant current decrease and the fault or other interruption may go unnoticed. While not typically a concern in applications such as track switch heating where other electrical by-passes typically exist, such by-pass is of concern in running rail applications that handle higher speed traffic.

Therefore, it is an object of the presented inventions to provide non-contact railroad track heater systems that allows for heating a section of a rail without providing an electrical by-pass around that rail section. Such designs reduce the likelihood of faults or breaks in a track rail going unnoticed by virtue of a signal traveling through the track heater. It is another object of the presented inventions to provide railroad track heaters that include means to reflect heat emitted by the track heater towards a track rail. It is another object of the presented inventions to at least partially confine convective and radiant heat, generated by a heater, relative to a specific portion of a track rail. It is another object of the presented inventions to provide a railroad track heater having a reduced ground fault interruption trip setting.

According to various aspects, a non-contact rail heater is provided that is adapted to provide heat to a rail section without providing an electrical by-pass or otherwise disrupting electrical signals passing through rail section. The heater includes at least one heating element for transferring heat to a rail section and a hood or housing that is adapted to suspend the heater element proximate to a surface of a track rail. The hood positions the heating element relative to the rail section such that a gap exists between the heating element and the rail section. As will be appreciated, as the heating element does not contact the rail, the heating element cannot form an electrical by-pass for signals passing through the rail section. In addition to suspending the heater element, the hood is adapted to at least partially surround the heating element to reduce heat losses to the ambient environment.

In one arrangement, the heater includes an electrically grounded case or housing. As the grounded case/housing does not contact the track rail, the electrical ground does not ground electrical signals passing through the track rail section.

Any type of hood or housing may be used that operates to at least partially shield the heater element from weather elements (e.g., snow, rain, wind) while the heater element is situated between the hood/housing and a track rail. The hood typically at least partially encloses and/or surrounds the rail heater relative to a track rail to inhibit heat loss to the ambient environment. In one arrangement, the hood may be formed as a wall or plate that may extend from a portion of the track rail (e.g., head flange) to a portion of a support tie underlying the track rail. Such a wall may be planar or may include a curved surface. In other variations, the hood member may consist of a pair of walls or plates that may be disposed at an angle to one another. In another arrangement, the hood may be a recessed member that is itself supported relative to a portion of the track rail. The, the hood may include a recessed inside surface that is adapted to face the track rail. The size of the recessed surface may vary to increase or decrease the size of an area enclosed between the hood member and the track rail to provide additional room for components and/or increase the heating effect of the track heater. In further embodiments, end plates or walls may be appropriately mounted to the ends of the hood to further isolate an interior of the hood from the ambient environment. Such end walls may be operable to further inhibit or reduce the loss of heat to the ambient environment. In some arrangements, the end walls may be disposed at least generally perpendicularly to the track rail when the hood member is disposed against the track rail. The hood member may also be of any appropriate dimensions and constructed of any appropriate materials. For instance, the hood member may be constructed of electrically non-conductive and/or insulative materials.

At least one track heater is supported relative to the inside surface of the hood in a manner that maintains a gap between the track heater and the track rail. Stated otherwise, the track heater may be mounted such that no portion of the track heater is in contact with the track rail. For instance, a mounting arrangement may serve to position the track heater to be in a fixed spaced relationship with the track rail. In this regard, the mounting arrangement may be disposed between a portion of the hood (e.g., inside surface) and a portion of the track heater.

The mounting arrangement may include a bracket assembly with opposing first and second ends, the first end being attached to the inside surface of the hood and the second end being attached to track heater; each attachment may be in any appropriate manner (e.g., bolts, rivets, adhesives). Generally, the mounting assembly maintains an appropriately sized space between the track heater and the track rail and/or between the heater and the hood. Additional track heaters or other componentry can be mounted to or adjacent to the inside surface of the hood via additional mounting arrangements.

In some instances, the hood may include radiative linings or shields (e.g., heat reflection devices) to reflect heat generated by the track heater(s) towards portions of the track rail. The radiative element may be appropriately mounted adjacent the inside surface of the hood and in this regard may be disposed between the hood and the track heater. For instance, the radiative element may be in the form of a plate or sheets of metal that may have a high emissivity. Alternatively, a coating may be applied to the inside surface that has an emissivity that is higher than the emissivity of the rail. In some variations, the radiative element may be mounted generally flush with the inside surface of the hood.

Any appropriate mount may be utilized to removably or non-removably steady or otherwise hold the hood (and track heater mounted therein) relative to a portion of the track rail. In one arrangement, at least one hinge pivotally connects the hood to a support tie. In this regard, the hood may be operable to pivot about the hinge to provide access to interior portions of the hood. In another arrangement, one or more mounts suspend the hood above the foot/flange of the track rail and relative to a surface (e.g., head, web, etc.) of the track rail. A portion of the hood may include a bumper of any appropriate material (e.g., rubber, plastic) attached along an interface edge between the hood and the track rail.

In another arrangement, the mount may be in the form of at least one jack bolt structure (e.g., a pair of jack bolt structures) that may be operable to exert opposing forces against inside surfaces of support ties to removably mount the hood to the support ties and adjacent a track rail.

The hood may include at least one access hole or aperture for providing access to portions outside of the hood for components disposed within the hood. Such access aperture may allow a heat detection device (e.g., infrared scanner/sensor) to detect hot boxes located in passing trains overhead. Such heat detection device may be appropriately mounted within the hood adjacent the access to detect the hot boxes through the access hole. The access hole may include a cover (e.g., lens, transparent plate) to prevent weather elements from gaining access to interior portions of the hood.

Other embodiments will become apparent from the teachings herein disclosed.

DETAILED DESCRIPTION

Figure 1:
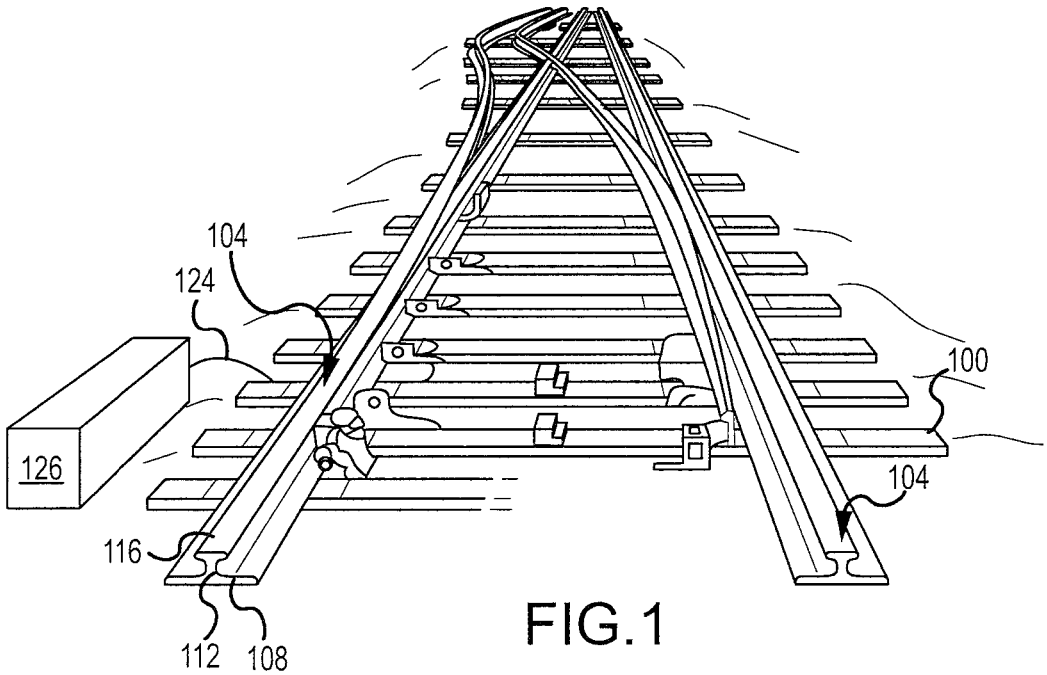
FIG. 1 is a perspective view of a conventional railroad track.

Referring to FIG. 1, illustrates a conventional railroad track at a switching location. The track includes at least two track rails 104 mounted on a plurality of support ties 100. Each track rail 104 includes a mounting flange 108 that rests on the plurality of support ties 100, a head flange 116 including a wheel bearing surface, and a web portion 112 interconnecting the mounting flange 108 and the head flange 116. The web portion 112 includes a gauge (inner) side and an opposite field (outer) side.

Figure 2B:
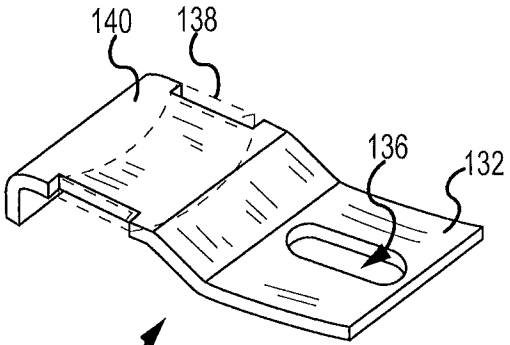
FIG.2B (PRIOR ART)
FIG. 2B is a perspective view of a clamp for affixing the heater of FIG. 2A directly to a track rail.
Figure 2A:
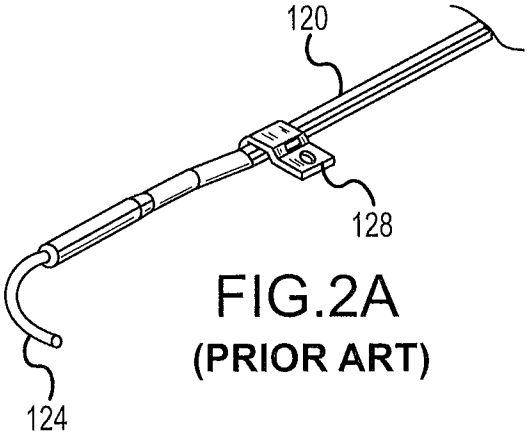
FIG.2A (PRIOR ART)
FIG. 2A is a perspective view of an exemplary track heater.

At such switching locations in cold climates a track heater (not shown) is mounted to the field side of the web portion 112 of the track rail. As shown in FIG. 2A, the track heater 120 may include an electrical line 124 that connects the heater 120 to a utilities outlet 126 (See FIG. 1), generator or other power source to provide power to the heater. While the track heater 120 is typically mounted to the field side of the track rail 104, those of ordinary skill in the art will appreciate that the track heater can be mounted anywhere it is necessary to have an area substantially devoid of snow, ice or other forms of precipitation, such as on the gage side of the rail near a track switch, frog structure, switching rail, hotbox detector, etc. The track heater 120 may be appropriately associated with temperature controls (e.g., thermostats, thermistors) to allow an operator or other user to select a desired temperature and/or radiant heat output of the track heater 120.

FIG. 2A illustrates one methodology for mounting the track heater 120 directly to a surface a track rail. As shown, one or more mounting brackets 128 may be disposed along the length of the track heater 120 to affix the track heater to the rail. As shown in FIG. 2B, each mounting bracket 128 includes a first portion 132 for removably attaching (e.g., bolting) the mounting bracket 128 to a track rail 104, and a second portion 140 for removably mounting the track heater 120 to the track rail 104. The first portion 132 may include at least one bore 136 for accepting any appropriate fastener (not shown) to attach the first portion 132 to the field side of the track rail 104. The second portion 140 may be in the form of a generally curved member that may define a concave space facing towards the track rail 104 and sized to receive the track heater 120. In one arrangement, a spring clip 138 is positioned within the concave space for urging the track heater 120 against the rail 104 when the bracket is secured to the rail. Such a mounting bracket is disclosed in U.S. Pat. No. 6,104,010 the contents of which are incorporated herein by reference. Generally, any mounting bracket connecting a rail heater to a rail maintains the metallic sheath/jacket of the track heater in direct contact with the track rail. Though not illustrated to scale, it will be appreciated that such track heaters may be of considerable length. For instance, some track rail heaters exceed 36 feet in length.

Track rails are often monitored for breaks or faults using electrical signals that pass through the track rails. If a monitored signal in a particular rail section changes or becomes open, it can be an indication that there is a break or fault in that section of track rail. One concern is that if such a break or fault occurs between the ends of a track heater having an electrically conductive jacket in contact with a track rail, the signals may potentially by-pass the fault and be conducted through the track heater. Accordingly, a rail heating assembly is provided that eliminates the ability of track carried signals bypassing breaks or faults through the track heater.

Figure 3:
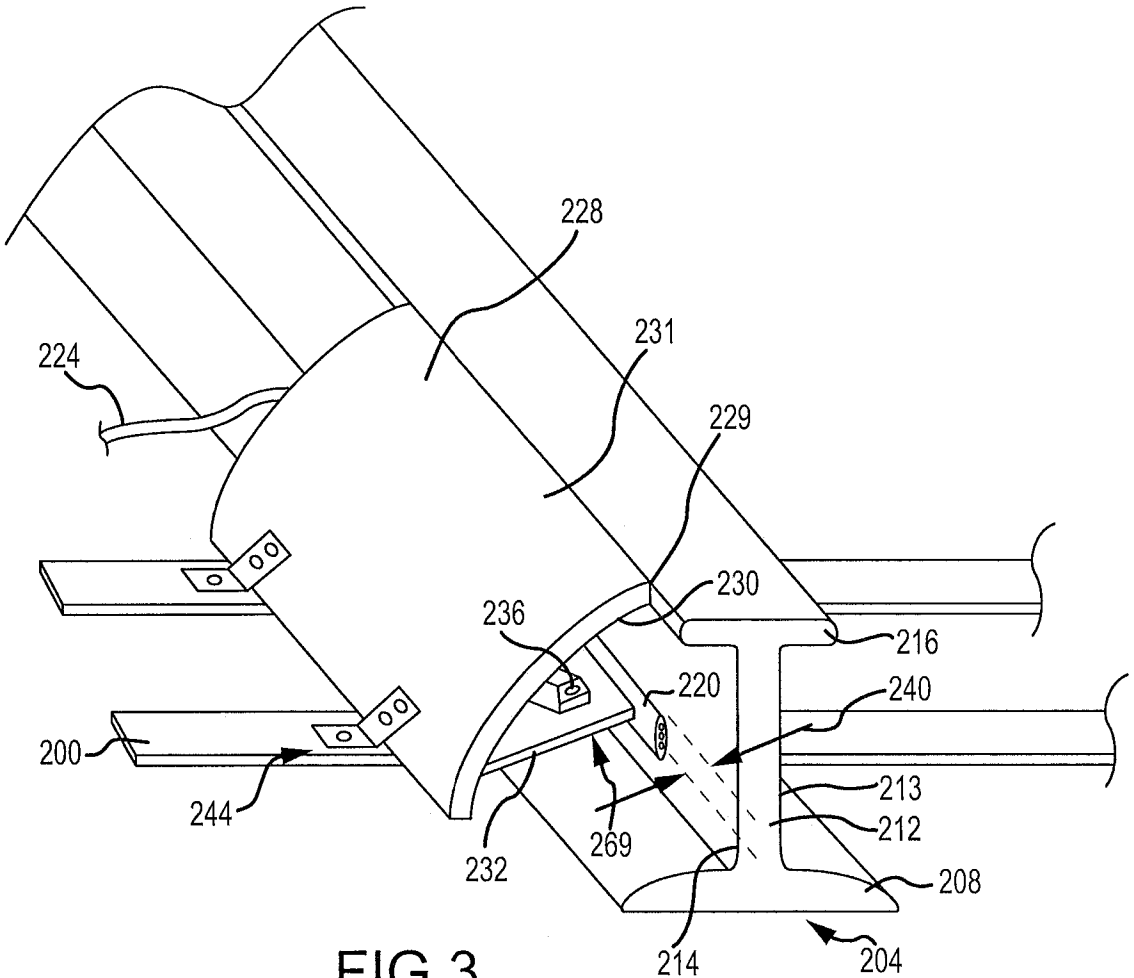
FIG. 3 is a perspective view of the track heater assembly according to one embodiment of the present invention.
Figure 4:
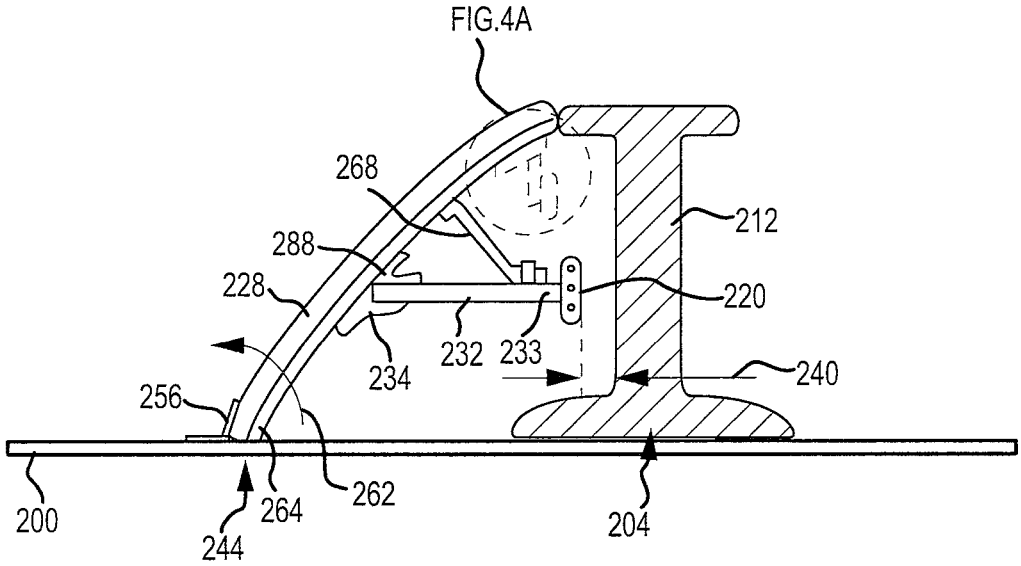
FIG. 4 is a sectional view along the line 4-4 of FIG. 3.

With reference to FIGS. 3-4, one embodiment of an assembly for heating a rail section of a railroad track according to the present invention is illustrated. The track includes at least two track rails 204 (only one being shown) mounted on a plurality of support ties 200. Each track rail 204 includes a mounting flange/foot 208 that rests on the plurality of support ties 200, a head flange 216 including a wheel bearing surface, and a web portion 212 interconnecting the mounting flange 208 and the head flange 216. The web portion 212 includes a gauge side 213 and a field side 214.

Mounted in a spaced relationship from a field side portion 214 of the track rail is a track heater 220. The track heater 220 may include at least one electrical line 224 that connects the track heater 220 to a utilities outlet, generator or other power source to provide power to the heater. It will be appreciated that the electrical lines may extend from a common end of the heater 220. The electrical line 224 typically may include two conducting wires, which are encased in any appropriate sheathing. The track heater 220 is mounted by an arrangement that maintains the heater in the fixed spaced relationship to the surface of the track rail. That is, the mounting arrangement maintains a space or gap 240 between the track heater 220 and the track rail 204. The space or gap 240 between the track heater and any conductive portions of the rail reduces the likelihood of an electrical bypass around a break or fault in the track rail 204.

With continued reference to FIGS. 3-4, the arrangement broadly includes a hood member 228, the track heater 220 and a mounting arrangement 267 that mounts the track heater 220 to the hood member 228 in a position proximate to and spaced from the surface of the track rail 204. The hood member 228 forms a housing that supports the track heater 220 and concentrates heat from the heater on the track rail 204. That is, as the track heater 220 is not in direct contact with the track rail, heat transfer from the heater 220 to the rail is via radiative transfer and convective transfer rather than conductive transfer. If the heater were substantially exposed to the ambient environment, much of the heat generated by the heater would be lost as opposed to being absorbed by the track rail 204. For instance, if unprotected wind may carry much of the heat away before being absorbed into the track rail. Generally, the hood member is configured as one or more walls that extend from a portion of the track rail (e.g., head flange 216) to the support ties 200. The length of the hood may be varied to accommodate heaters of differing lengths. The hood member and track rail collectively define an at least partially enclosed volume or interior/inside surface (i.e., between the rail and the hood member) for housing the heater element(s) 240. Further, the hood member will usually include endplates/walls at both ends to further isolate the heater 220 within the inside surface from the ambient environment. See, for example, FIG. 6. Stated otherwise, the hood member 228, when disposed against the rail 204, provides a substantially enclosed volume that helps isolate the heater 220 and the heat generated by the heater.

The hood member 228 may either be a self-supporting structure or may be partially supported by the track rail. In the former regard, the end plates (see, e.g., FIG. 6) may allow the hood member to stand in an upright position, as shown in FIGS. 3-9, without support from the track rail. Alternatively, the hood member may lean against the rail head such that the rail at least partially supports the hood member. In a further embodiment, the hood member may be suspended against a portion of the track rail.

The design of the hood member 228 also prevents electrical bypass around a break or fault in the track rail 204. That is, at least the portion of the hood member 220 that contacts the rail is constructed of an electrically non-conductive material. Such materials include, without limitation, woods and fiberglass. Although not shown, front edge 229 of the hood member 228 may be provided with at least one bumper (e.g., rubber, plastic) to prevent damage to either the hood member 228 or the head flange 216 of the track rail 204. Moreover, the bumper can provide shock or vibration absorbing properties to isolate the track heater from track rail vibrations and prevent damage from accruing to the track heater 220. Additionally, the hood member can include handles (not shown) to facilitate pivoting of the hood member 228 about a hinge 256, which may pivotally connect the hood member to the support ties 200.

In the present embodiment, the hood member 228 is a curved member having a recessed inside surface 230 (e.g., concave) and an outside surface 231 (e.g., convex). In this regard, the hood member 228 may facilitate the drainage of moisture (e.g., rain, snow) away from the hood member and ultimately the track heater 220. In other embodiments, the hood member 228 may be in the form of multiple planar/plate members and/or a singular plate member that may be adapted to extend linearly from a portion of the track rail 204 (e.g., head flange 216) to the support ties 200.

Mounting brackets 244 may attach the hood member 228 to the support ties 200. As shown in FIG. 3 and more clearly in FIG. 4, in the present embodiment each mounting bracket 244 may include a hinge member 256 having a first portion attached to the hood member 228 and a second portion attached to the support tie. The hinged mounting bracket 244 allow the hood member and attached track heater 220 to be pivoted about the hinge 256 as is represented by arrow 262. Such an arrangement allows an operator or other technician convenient access to the track heater for repair or replacement thereof. However, use of such hinged mounting brackets is not a requirement.

Continuing to refer to FIGS. 3-4, a heater mounting arrangement 267 is shown. While one embodiment of the heater mounting arrangement 267 will be described, those of ordinary skill in the art will appreciate that any mounting arrangement can be utilized that suspends the track heater proximate to a desired surface of the track rail. The heater mounting arrangement 267 may be in the form of a bracket assembly that include at least one cantilever member 232 (e.g., bracket, plate) having a forward end 233 that is adapted to support the track heater 220 at a distance spaced from the foot or web portion 212 of the track rail 204. The cantilever member 232 may be constructed of any appropriate materials and of any appropriate dimensions. The track heater 220 can be mounted on the forward end 233 of the cantilever member 232 by any means known in the art such as, but not limited to, adhesive, bonding, screws, rivets, spring clamps, etc. The rearward end 234 cantilever member 232 can be mounted to the hood member 228 by any means known in the art, such as by adhesive, bonding, screws, bolts, etc. In one arrangement, the rearward end 234 is received within a bracket 288 mounted to the inside surface of the head member 228.

To provide additional support for the cantilever member 232 and the track heater 220, an angled support 268 may be provided. The angled support 268 includes a first end that fixedly attached to the hood member 228 and second end fixedly attached to the cantilever member 232. The ends of the angled support can be mounted to the hood number 228 and cantilever member 232 by screws, bolts, adhesives, rivets, etc.

The hood member 228 may further include an optional radiative shield or lining 264 mounted inside of the hood member to enhance the heating effect of the track heater 220 on the track rail 204 by radiating heat emitted by the track heater 220 back onto the track rail 204. For instance, the lining 264 may include any appropriate reflective coating (e.g., paint, metal lining, etc.) having a high emissivity to reflect radiant heat onto the rail 204. As the track 204 is typically constructed of a material having a low emissivity (e.g., dark, dull materials), the track rail 204 may readily absorb radiant heat from the track heater 220 as well as radiant heat reflected from the lining 264. It will be appreciated that such a shield or lining may also protect the hood member 228 from heat produced by the track heater 220 in addition to isolating heat generated by the track heater 220 within the hood member 228.

Figure 4A:
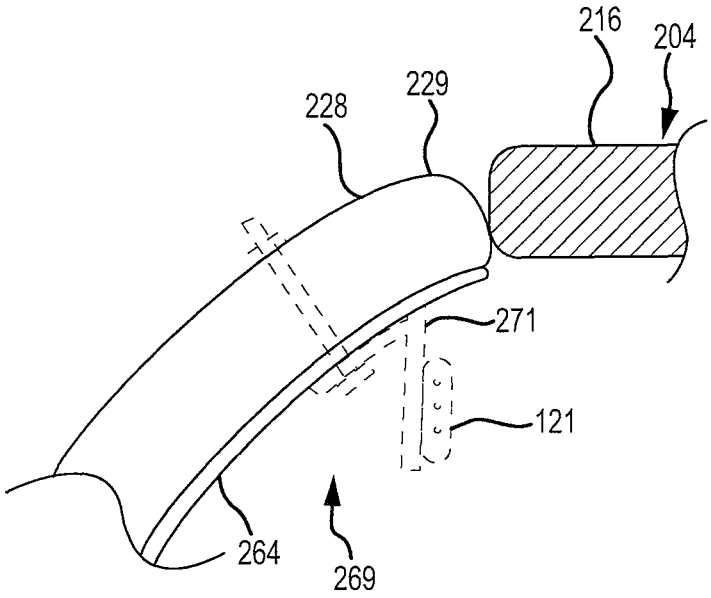
FIG. 4A is close up sectional view of the track heater assembly of FIG. 3 including an optional second track heater.

As illustrated in FIG. 4A, an optional second mounting arrangement 269 may be provided for mounting a second track heater 121 in spaced relation to the track rail 204. It is envisioned that the second track heater 121 may be mounted in addition to or alternative to the track heater 120, and in this regard may provide additional radiant and/or convective heat to the track rail 204 and/or provide radiant and/or convective heat to a different portion or component of the track rail 204.

The mounting arrangement 269 may include any arrangement that can maintain the track heater 121 in a spaced relation to the track rail 204. For instance, the mounting arrangement 269 may include an angle bracket 271 (e.g., iron) that may be adapted to removably position the track heater 121 relative to the track rail 204. It will be appreciated that angle brackets 271 of various sizes and dimensions may be provided to provide a desired positioning of the track heater 121 relative to the track rail 204. In one embodiment, the angle bracket 271 may be in the form of an elongated L or V-shaped bracket that extends substantially from one end of the hood member 228 to the other end of the hood member 228. In other embodiments, the angle bracket 271 extends less than from one end to the other end of the hood member 228. The angle bracket 271 may be a one-piece structure or composed of multiple components. Other arrangements are envisioned. The angle bracket 271 may be mounted to any appropriate portion of the hood member 228 and/or lining 264, and the track heater 121 may be mounted to the angle bracket 271 in any appropriate manner (e.g., bonding, screws, rivets, spring clamps).

As noted above, the electrical heater element is interconnected to a power source. In various arrangements, the power source delivers 300-500 watts electrical power per linear foot at voltages between 240-600 volts (AC). Other arraignments may utilize high voltage (e.g., 750) direct current (DC) power sources. In order to protect the equipment and users from potential electrical shorts or shocks, track rail heater elements are typically interconnected to a ground fault interruption (i.e., GFI) circuit, which is also sometimes referred to as a residual current device (i.e., RCD). For instance, such RCD equipment may be maintained in the power source outlet or control panel 126. (See FIG. 1)

An RCD is an electrical wiring device that disconnects a circuit whenever it detects that the electric current is not balanced between the energized conductor and the return neutral conductor. That is, the supply and return currents must sum to zero; otherwise, there is a leakage of current to somewhere else (to earth/ground, or to another circuit, energizing a section of track rail, etc.). An electrical shock or the electrification of an object can result from these conditions. RCDs are designed to disconnect electrical power quickly enough to mitigate the harm caused by such leakage. For instance, RCDs are often designed to prevent shock potential by detecting the leakage current, which can be far smaller (typically 5-30 milliamperes) than the currents needed to operate conventional circuit breakers or fuses (several amperes). RCDs are intended to operate within 25-40 milliseconds. In the United States, the National Electrical Code requires RCD/GFI devices intended to protect personnel to interrupt the circuit if the leakage current exceeds a range of 4-6 mA of current (the trip setting is typically 5 mA) within 25 milliseconds. RCD/GFI devices which protect equipment (not personnel) are allowed to trip as high as 30 mA of current.

The higher equipment trip setting reduces the number of inadvertent/nuisance trips for equipment. Further, the higher trip setting is often a practical requirement in systems where equipment is not grounded. As will be appreciated, the electrical connections for most electrical devices having metallic casings, housings or chassis include a grounding wire that extends between the metal housing/chassis of the electrical equipment and a ground location/earth ground. In such an arrangement, current imbalance for the energized conductor and the return neutral conductor is measured relative to the grounding wire and low (e.g., 4-6 mV) trip levels are achievable. In contrast, for non-grounded systems, such measurement is made in reference to ground remote from the equipment itself. Such measurement is often performed at the supply panel taken between each conductor and a ground reference represented by a direct physical connection to the Earth.

While providing a means for monitoring current balance for RDC/GFI purposes, such remote earth referencing typically requires a higher trip setting (e.g., 30 mA) as current variation within the lines extending between the supply panel and the equipment and/or the earth ground itself can have some variation. That is, such remote referencing of the current balance is not accurate as measuring the current of the conductors against a ground wire that is attached to, for example, the casing of the equipment. Accordingly, to prevent nuisance trips, higher trip settings are typically required.

As track rail heater elements have heretofore been designed to physically contact the surface of track rails, it has not been possible to electrically ground the cases of these heater elements. As may be appreciated, if the electrically conductive case of such a heater element were grounded, the signals passing through the track rails may likewise be grounded, thereby preventing the effective monitoring of a track rail section for faults. This has required that such heater elements be non-grounded and utilize a remote ground reference. Accordingly, such heater elements have required high trip settings (e.g., 30 mA).

The ability to maintain the heater element in a fixed spaced relationship away from the surface of the metallic track rail provides an additional benefit, namely, the ability to ground the metallic case of the heater element. That is, as the metallic case no longer contacts the track rail, the metallic case may be grounded with a ground wire, which allows for reducing the trip setting of a RCD/GFI device attached to the power source of the heater. In this regard, a RCD/GFI setting that complies with personnel standards (e.g., 4-6 mA) rather than equipment standards (e.g., 30 mA) may be implemented.

Figure 2C:
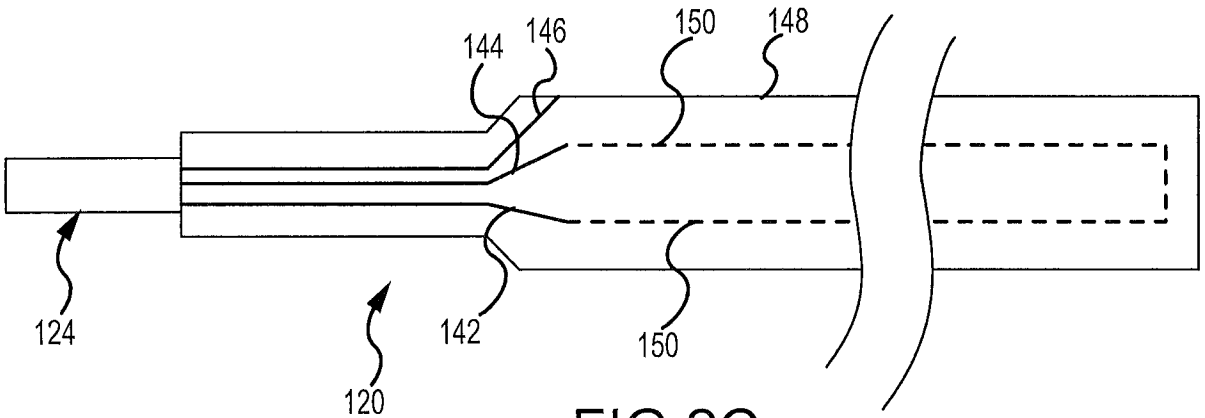
FIG. 2C illustrates an electrically grounded track rail heater.

FIG. 2C illustrates a heater 120 that includes a grounded case/sheath. As shown, an electrical line 124 connects the heater 120 to an external power source (not shown). In some arrangements, the electrical line 124 may also include a high voltage quick connector (not shown) that allows for readily connecting and disconnecting the heater. In the present embodiment, the electrical line includes first and second conductors 142, 144 (e.g., energized conductor and the return neutral conductor). As shown, the heater 120 utilizes a folded internal heater element(s) 150 that has terminals located on a common end for connection to the conductors 142, 144.

The electrical conductors 142 and 144 are connected to the terminals of the internal heater element(s) 150 within the housing or case 148 of the heater 120 and are typically sealed against the elements. Though illustrated as having a single heating element, it will be appreciated that the heater may include multiple elements. In one arrangement, three heater element(s) 150 may be welded near the terminal housing to internal cold pins (not shown) that establish an electrical connection to the heater elements while substantially thermally isolating the electrical conductors 142, 144 from the heater element. Further, for protection against the elements, the connections between the conductors and the heater element(s) may be encapsulated in epoxy, a silicon/fiber glass or other insulator.

Figure 5:
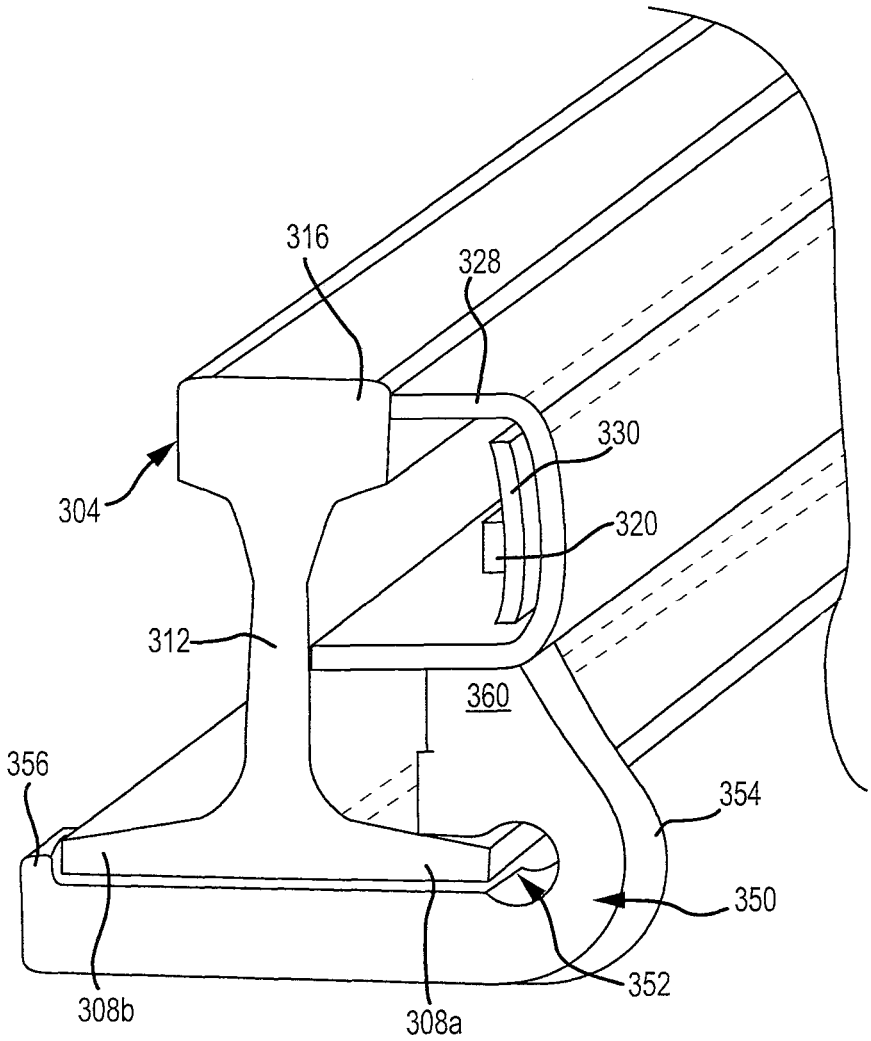
FIG. 5 is a cross-sectional view of a track heater assembly according to another embodiment of the present invention.

The housing 148 is typically constructed from a durable material and most commonly a metal. The illustrated housing 148 is formed from steel or metal alloy approximately 0.25 inches thick. Furthermore, in the present embodiment, an electrical ground wire 146 is electrically connected to the housing 148 to provide an electrical ground for the heater. Referring to FIG. 5, another embodiment of the track heater assembly is shown. As shown, a recessed hood member 328 provides an at least partially enclosed interior for housing a track heater 320. Though shown as being substantially U-shaped along its cross-sectional profile, it will be appreciated that the hood member may have any recessed shape that allows for engaging first and second surfaces of a track rail to provide an at least partially enclosed housing for a heater element. Generally, the hood member 328 is an elongated member the length of which may be chosen to accommodate the length of a particular heater. In addition, end plates (not shown) may be provided to substantially cover the ends of the hood member. This may reduce convective heat loss to the ambient environment. In the present embodiment, an upper portion of the hood member 328 is adapted to engage the head flange 316 of the track rail 304 and a lower portion of the hood member 328 is adapted to engage a web portion 312 of the track rail 304. That is, a first contact surface contacts the head flange and a second contact surface contacts the web. Accordingly, this may require that the hood member be suspended above the foot of track rail.

As may be appreciated, the foot/flanges 308 of a track rail are commonly interconnected to underlying ties utilizing periodically spaced spikes, tie plates and/or clamps. Irrespective of the exact mechanism that interconnects the track rail to the underlying ties, the attachment mechanism often protrudes above the top surfaces of the flanges. Accordingly, the protrusion of these attachment mechanisms may complicate positioning of a housing or hood member relative to the track rail. Suspension of the hood member 328 above the foot/flange 308 of the track rail may simplify positioning of the hood member 328 and track heater 320 relative to the track rail. That is, the lower edge of the hood member 328 may be spaced above the top of the flange 308 such that the heater assembly is disposed above the attachment mechanisms that hold the track rail relative to underlying ties. It will be appreciated that the suspended hood member 328 may be differently configured to engage different portions of the track rail.

As above, the hood member 328 may include a mounting arrangement that maintains a fixed gap or spacing between the track heater 320 and the track rail 304. As previously described, the gap eliminates contact between the heater and the track rail 304 and thereby prevents the potential of any electrical bypass of signals carried by the track rail 304 through the heater. The present embodiment further includes a reflector/radiative shield 330 that is disposed between the closed end of the hood member 328 and that heater 320.

One or more mounts or attachment devices 350 are used to secure the hood member 328 relative to the track rail. Typically, at least first and second attachment devices may be spaced along the length of the hood member to provide support. In the illustrated embodiment, the attachment device is a wrap-around spring clamp/anchor that supports the hood member. This anchor 350 is a wraparound anchor that extends across the bottom of the track rail 304 to engage the both flanges 308*a*, 308*b* of the track rail 304. The wraparound anchor may be applied to the track rail by disposing a flange into a receiving slot 352 and striking the end 359 of the anchor 350. This has the effect of driving the flange 308*a* into slot 352 such that a flange tab 356 may extend over the end of the opposing flange 308*b*. The wraparound anchor also incorporates a support 360 that engages a lower surface of the hood member 328 and correctly positions the hood member relative to the track rail. It will be appreciated that various clamps or anchors may be utilized to suspend the hood member relative to the track rail. A non-limiting set of such clamps/anchors are set forth in U.S. Patent Publication No. 2006/

0032934 entitled: "Non-invasive railroad attachment mechanism" the contents of which are incorporated herein.

Figure 6:
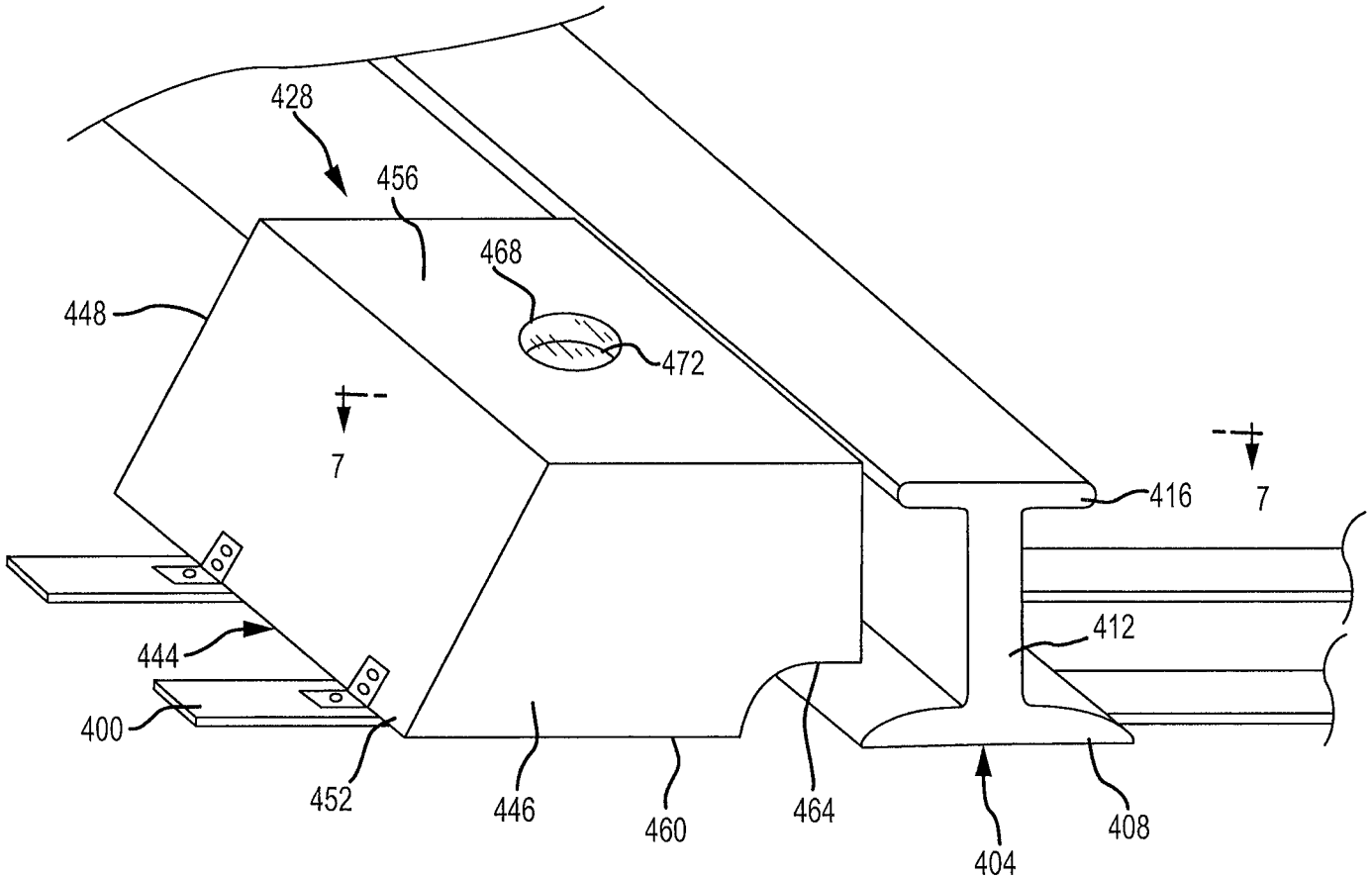
FIG. 6 is a perspective view of a track heater assembly according to another embodiment of the present invention.
Figure 7:
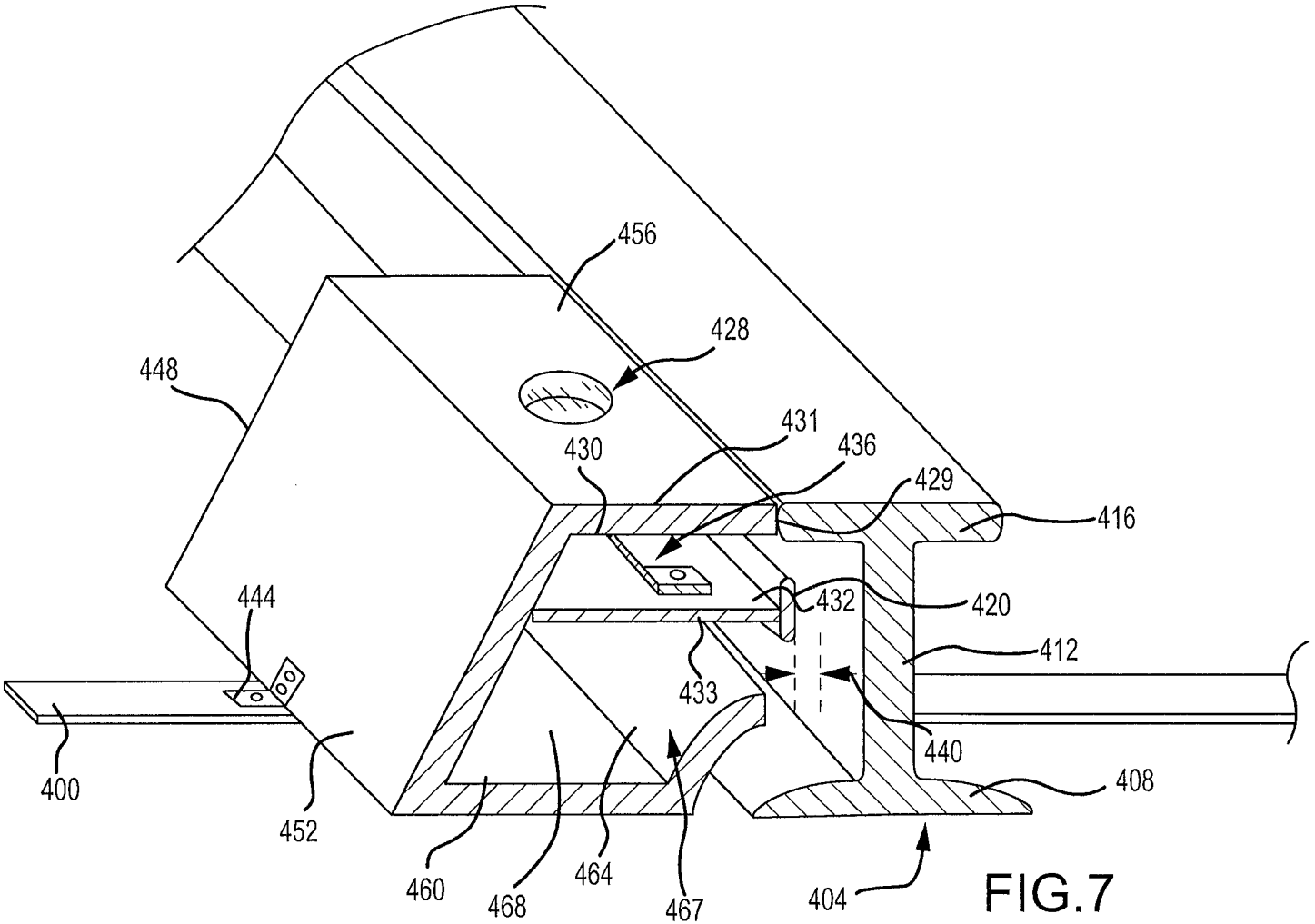
FIG. 7 is a sectional view along the line 7-7 of FIG. 6.

With reference to FIGS. 6-7, another embodiment of the track heater assembly of the present invention is shown. The assembly includes at least two track rails 404 each having a mounting flange 408, web portion 412 and a head flange 416 as described in previous embodiments. Again, a hood member 428 is provided that includes an inside surface 430 (e.g., recessed or concave surface) and an outside surface 431. As shown, the hood member 428 includes a first side or end wall 446, a second side or end wall 448, a back wall 452, a top wall 456, a bottom wall 460 (optional), and a partial front wall 464 (optional). As illustrated, the first and second end walls 446, 448 may be disposed generally perpendicularly to the longitudinal axis of the track rail 404. The first and second end walls 446, 448 may serve as a barrier to reduce or prevent weather elements from passing through the inside of the hood member 428 from lateral ends of the hood member 428. The hood member 428 and rail 404 define an at least partially enclosed volume. Again, the hood member 428 maintains (e.g., suspends) the track heater 420 in close proximity to the track rail 404 thereby maintaining a gap between the track heater 420 and the track rail 404. Because the suspended track heaters provide heat to the track rail 404 by convective and radiative heat transfer, reduction of heat losses from wind, ambient air and other weather elements is important. Thus, it is important that the hood member 428 shield or otherwise reduce such weather elements from passing through the hood member and carrying off heat generated by the track heater.

The hood member 428 may also have one or more access apertures 468 on or through any appropriate portion thereof for providing access to inside the hood member 428. As shown, the access hole 428 is situated through a portion of the top wall 456, and a lens or cover 472 (e.g., transparent cover) is disposed over the access hole 468. In such an arrangement, a heat detection device (e.g., infrared sensor, not shown) may be appropriately mounted or otherwise disposed within the hood member 428 adjacent the access hole. The heat detection device may be Operable to detect hot boxes on trains passing overhead through the cover 472 of the access hole 468. The access hole 468 and cover 472 may be of any appropriate number, size and at any appropriate location or locations on or through the hood member 428. It will be appreciated that co-location of the sensor with the heater may prevent ice/snow buildup on the sensor.

Mounting brackets 444 mount the hood member 428 to support ties 400, and allow the hood member 428 to be pivoted about the mounting brackets 444 to provide a technician or other operator access to the track heater within the hood member for repair or replacement thereof. Mounting brackets 444 may be similar to those as previously described and therefore will not be described in further detail. Additionally, an optional front wall 464 may be adapted to rest on mounting flange to provide for enhanced stability of the hood member 428 with respect to the track rail 404 as seen in FIG. 6 and FIG. 7.

With reference to FIG. 7, a sectional view through the lines 7-7 of FIG. 6 is illustrated that provides for an interior view of the hood member 428. Similar to the embodiment of FIGS. 3-4, the track heater assembly includes a mounting arrangement 467 that is adapted to maintaining a gap 440 between the track heater 420 and the web portion 412 of the track rail 404.

Figure 8:
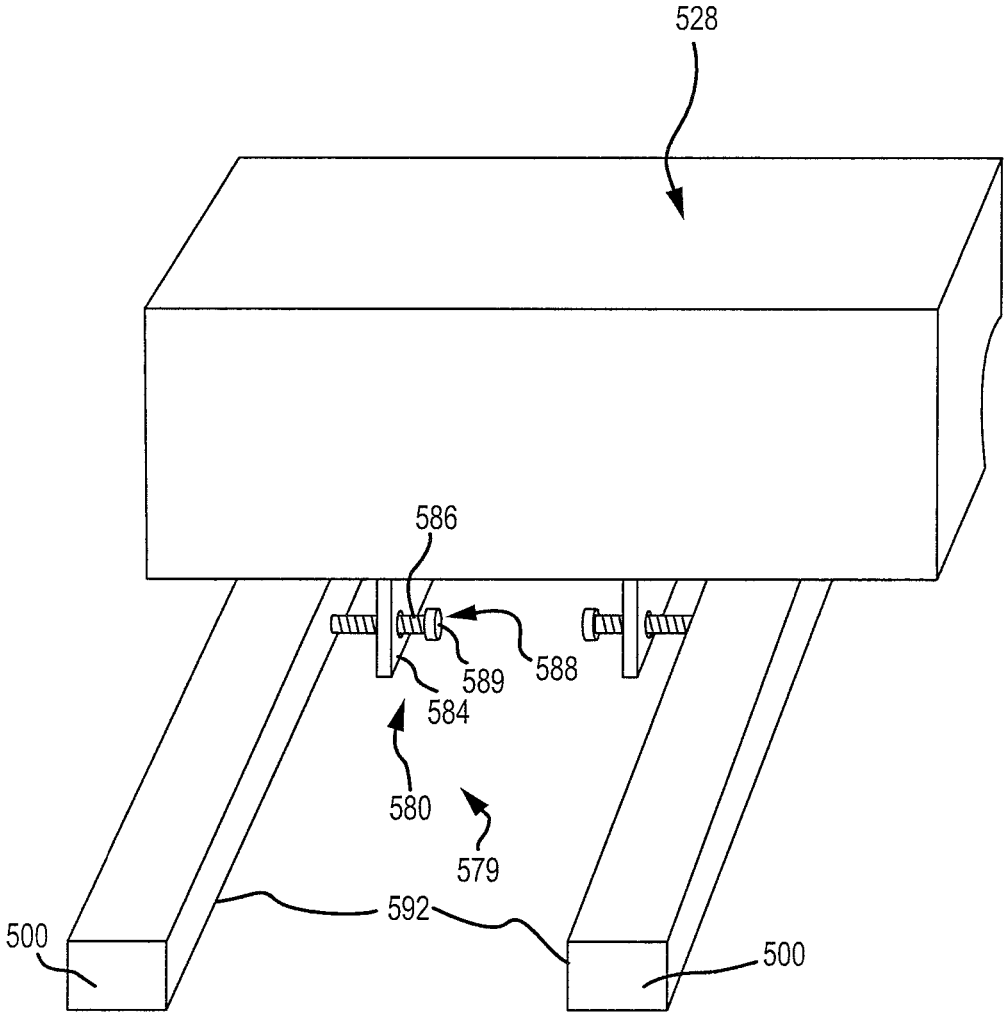
FIG. 8 is a perspective view of a track heater assembly similar to the embodiment of FIG. 6, but including a pair of jack bolt assemblies.

FIG. 8 illustrates a variation of a mounting assembly for mounting any of the hood members relative to support ties of the track heater assembly of FIGS. 6-7. For convenience and clarity, all components (e.g., track rails) have been shown and like reference numerals will be used when possible. In this embodiment, the hood member 528 may be provided with a mounting assembly 579 that may be operable to removably secure the hood member 528 to at least one support tie 500. As shown in FIG. 8, the mounting assembly 579 may include a pair of jack bolt assemblies 580, each jack bolt assembly 580 being adapted to exert a force against a portion of a support tie 500.

Each jack bolt assembly 580 may include a downstanding tang 584 that may be mounted to the hood member 520. The downstanding tang 584 may be in the form of a bracket, plate, and the like, and may include at least one threaded opening 586 extending therethrough. A jack bolt 588 may be received through the threaded opening 586 and thereafter moved towards and away from a portion of a support tie 500. The jack bolt 588 may have a head portion 589 configured to engage any appropriate tool (e.g., wrench). Additional threaded openings 586 may be included on the downstanding tangs 584 to correspondingly threadingly engage with additional jack bolts 588.

In operation, the hood member 528 with corresponding track heater (not shown) may be appropriately mounted on top of a pair of support ties 500 such that the mounting assembly 579 is received between the pair of support ties 500. Stated otherwise, the hood member 528 may be mounted on top of the support ties such that the jack bolt 588 of one jack bolt assembly 580 is facing an inside surface 592 of one support tie 500 and the jack bolt 588 of another jack bolt assembly 580 is facing the inside surface 592 of another support tie 500. An operator may need to appropriately thread one or more of the jack bolts 588 away from its respective support tie 500 to allow the jack bolt assemblies 580 to be received between the support ties 500. Thereafter, the operator may thread one or more of the jack bolts 588 towards its respective support tie 500 at least until both jack bolts 588 are engaged with a respective support tie 500, the inside surfaces 592 of the support ties 500 generally facing each other. At this point, the combined opposing forces created by the jack bolts 588 against the opposed inside surfaces 592 of the support ties 500 serve to removably mount the hood member 528 to the support ties 500.

Figure 9:
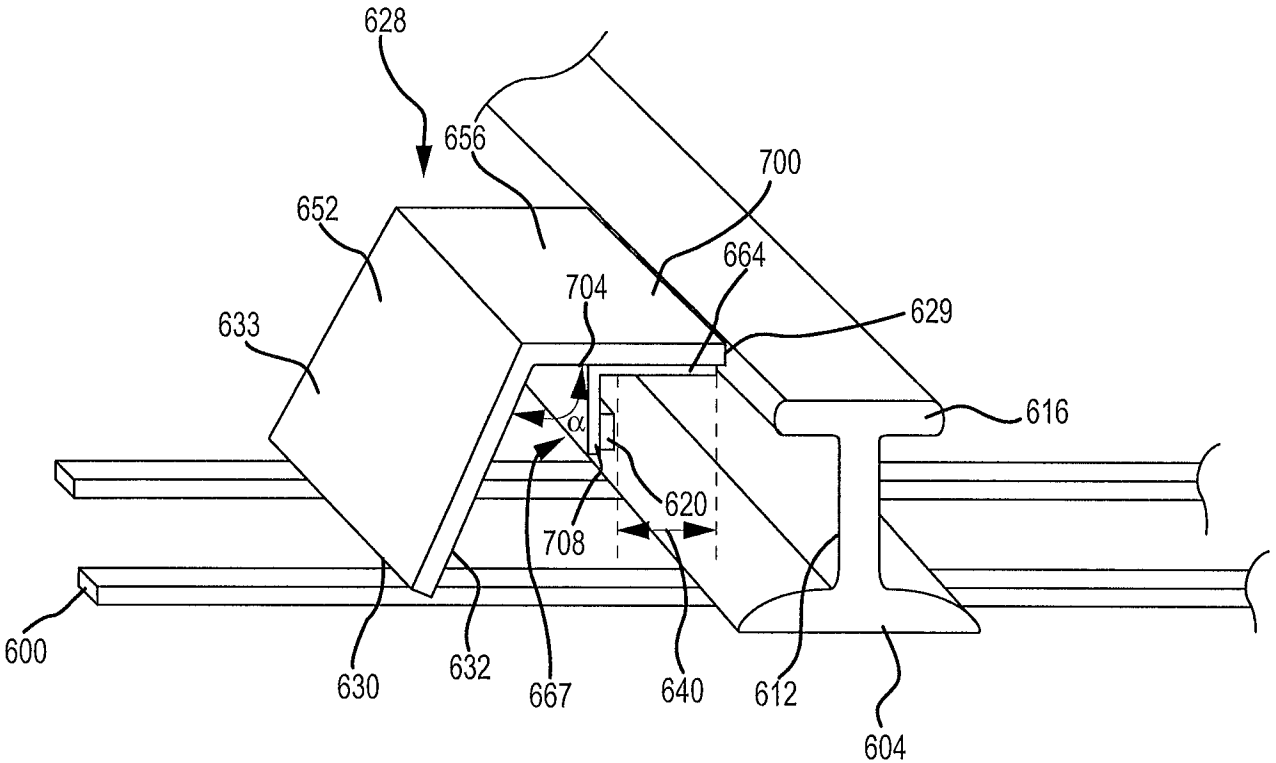
FIG. 9 is a perspective view of a track heater assembly according to another embodiment of the present invention.

FIG. 9 illustrates another embodiment of the track heater assembly. In this embodiment, the hood member 628 again includes a recessed inside surface 632 and an outside surface 633. The hood member 628 includes first and second plates 656, 652 disposed at an angle of a to each other that partially define an enclosed volume. The first plate 656 may be adapted to be disposed generally horizontal to the support ties 600 and may support the track heater 620 as will be described more fully below. The first plate 656 may include a first edge 629 that is adapted to rest against the head flange 616. The second plate 652 is connected to the first plate 656 and, in the present embodiment, slopes generally away from the first plate 656. Although the angle $\alpha$ may be of any appropriate value, if the angle $\alpha$ is greater than 90°, the sloping surface may facilitate the drainage of moisture (e.g., snow, rain) away from the track heater 620. Endplates (not shown) may be provided on the ends of the first and second plates to more fully enclose the inside surface of the hood members.

Again, the hood member includes a mounting arrangement 667 that maintains the track heater 620 relative to the track rail 604 such that a gap 640 exists between the track heater 620 and a portion of the track rail 604 (e.g., web portion 612). As previously discussed, the gap 640 may avoid any electrical bypass through the heater and around a fault or break in the track rail 604. As illustrated, the mounting arrangement 667 may be in the form of a bracket assembly that includes an angle bracket 708 of any appropriate material (e.g., iron) that may be adapted to removably position the track heater 620 relative to the track rail 604. The angle bracket 708 may be a one-piece structure or else be composed of multiple components. Other arrangements are envisioned. The angle bracket 708 may be mounted to the lower surface 704 and the track heater 620 may be mounted to the angle bracket 708 in any appropriate manner (e.g., bonding, screws, rivets, spring clamps).

With continued reference to FIG. 9, the lower surface of the first plate 656 may include at least one conductive plate 664 mounted on the inside of the hood member 628 that may enhance the heating effect of the track heater on the rail by reflecting heat emitted by the track heater 620 back onto the track rail 604. Moreover, if the conductive plate 664 is in contact with the angle bracket, the plate absorbs at least a portion of the heat generated by the track heater 620 (e.g., via conduction) and serves to heat the top surface of the hood member 628.

As previously described, the hood members of the present invention may be constructed of a non-conductive material so as to not provide an electrical bypass around any faults or breaks in the track rails. For instance, the hood members may be constructed of fiberglass, ceramics, polymers, etc. Additionally, the hood members could be constructed of a thermally insulative but electrically non-conductive material. Such a material avoids an electrical bypass while containing heat generated by the track heater thus increasing the effectiveness of the track heater. For instance, the hood or housing members could be constructed of various polymeric materials, composites, etc. Likewise, the surfaces of the hood member may be insulated. Moreover, to avoid heat losses from wind, ambient air or other weather elements passing through the hood members and carrying off heat generated by the track heaters, any of the hood members of the present invention can include closed or angled ends to prevent such heat losses from such weather elements.

Further, the radiative shield can be manufactured of any of various materials providing radiative effects such as various metals, composites, and the like that have high emissivities. Additionally, the cantilever member and the various spacing members and brackets of the present invention can be formed of many materials known in the art including, but not limited to, metals such as aluminum or steel, various polymers, etc.

While each of the track heaters of the various embodiments of the present invention is shown as being mounted near the field side of the track rail, those of ordinary skill in the art will appreciate that the track heater can be mounted anywhere it is necessary to have an area substantially devoid of snow, ice or other forms of precipitation, such as near a track switch, frog structure, switching rail, hotbox detector, other critical moving parts, etc. Additionally, the track heater could be mounted on the gauge side or other location near a track rail. Accordingly, the assembly of the present invention can be modified to fit such other locations. Moreover, any of the track heaters may include any appropriate coating or lining to enhance heat radiance while reducing electrical conductivity. For instance, a track heater may include a jacket on at least a portion thereof that is constructed of a polymeric material and a nitride or oxide such that the jacket is thermally conductive but electrically non-conductive.

Any of the features previously described with respect to particular embodiments may be utilized in conjunction with other embodiments. For instance, jack bolt assemblies, bumpers, radiative linings or shields, additional track heaters, angled brackets, access apertures, and/or doors may be appropriately used with embodiments other than embodiments those that such features were described with herein. Likewise, the various embodiments may utilize grounded heater elements or non-grounded heater elements. The above described embodiments, while including the preferred embodiment and the best mode of the invention known to the inventor at the time of filing are given as illustrative examples only. It will be readily appreciated that many deviations may be made from the specific embodiments disclosed in the specification without departing from the spirit and scope of the invention. Accordingly, the scope of the invention is to be determined by the claims below rather than being limited to the specifically described embodiments above.

The invention claimed is:

1. An assembly for heating a rail section of a railroad track, the assembly comprising:

at least one elongated heating element having a metallic outer surface; and a hood member having a recessed inside surface and a first contact surface proximate to an open end of said recessed inside surface adapted for disposition against a length of a track rail;

at least one fixture interconnecting said at least one elongated heating element to the recessed inside surface of the hood member, wherein said fixture supports the at least one elongated heating element within an interior of the recessed inside surface of said hood member and supports the at least one elongated heating element in a fixed spaced relationship to the length of track rail when said hood member is disposed against the length of track rail, wherein said at least one elongated heating element is suspended away from a surface of the length of track rail.

2. The assembly of claim 1, wherein said first contact surface of the said hood member is sized to contact a length of a head flange portion of the length of track rail and a second contact surface of said hood member is sized to contact a length of a web portion of the length of track rail.

3. The assembly of claim 1, further comprising:

at least one mount adapted to engage a flange portion of the track rail, wherein the mount extends between the hood member and the flange when the hood member is positioned relative to the track rail.

4. The assembly of claim 1, further comprising at least one reflector disposed between the hood member and the heating element.

5. The assembly of claim 1, wherein the hood member comprises an electrically non-conductive material.

6. The assembly of claim 1, wherein said elongated heater element comprises an electrically grounded metallic housing.

7. The assembly of claim 1, wherein the hood member and the track rail define an at least partially enclosed volume when the hood member positioned against the track rail.

8. The assembly of claim 1, wherein the hood member comprises at least one aperture.

9. The assembly of claim 2, wherein said hood member has a substantially U-shaped cross-section.

10. The assembly of claim 8, further comprising at least one heat detection sensor that is mounted to the hood member adjacent the at least one aperture.

* * * * *